US010501999B2

(12) United States Patent
Grosz et al.

(10) Patent No.: US 10,501,999 B2
(45) Date of Patent: Dec. 10, 2019

(54) SECURING MECHANISM FOR A DRILLING ELEMENT ON A DOWNHOLE DRILLING TOOL

(71) Applicant: Halliburton Energy Services, Inc., Houston, TX (US)

(72) Inventors: Gregory Christopher Grosz, Magnolia, TX (US); Brandon James Hinz, Conroe, TX (US); Seth Garrett Anderle, Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 229 days.

(21) Appl. No.: 15/107,020

(22) PCT Filed: May 15, 2015

(86) PCT No.: PCT/US2015/031038
§ 371 (c)(1),
(2) Date: Jun. 21, 2016

(87) PCT Pub. No.: WO2016/057076
PCT Pub. Date: Apr. 14, 2016

(65) Prior Publication Data

US 2018/0195351 A1 Jul. 12, 2018

Related U.S. Application Data

(60) Provisional application No. 62/060,401, filed on Oct. 6, 2014.

(51) Int. Cl.
*E21B 10/62* (2006.01)
*E21B 10/43* (2006.01)
(Continued)

(52) U.S. Cl.
CPC ..... *E21B 10/62* (2013.01); *E21B 10/42* (2013.01); *E21B 10/43* (2013.01); *E21B 17/1057* (2013.01)

(58) Field of Classification Search
CPC ..... E21B 10/62; E21B 10/42; E21B 17/057
See application file for complete search history.

(56) References Cited

U.S. PATENT DOCUMENTS 3,052,310 A * 9/1962 Kinzbach ..... E21B 10/26 175/406
3,563,325 A * 2/1971 Miller ..... E21B 10/58 175/420

(Continued)

FOREIGN PATENT DOCUMENTS

CN 103958814 7/2014
WO 1994-016191 7/1994

(Continued)

OTHER PUBLICATIONS

International Search Report and Written Opinion, Application No. PCT/US2015/031038; 15 pgs, dated Aug. 21, 2015.

(Continued)

*Primary Examiner* — D. Andrews
(74) *Attorney, Agent, or Firm* — Baker Botts L.L.P.

(57) ABSTRACT

A downhole drilling tool is disclosed. The downhole drilling tool may include a drill bit having a bit body, a blade disposed on an exterior portion of the bit body, the blade including a pocket and a pocket groove adjoining the pocket. The drill bit may also have a drilling element located in the pocket, the drilling element including a drilling-element groove at least partially aligned with the pocket groove. In addition, the drill bit may have a locking element extending through a combined space inside the pocket groove and the drilling-element groove.

19 Claims, 11 Drawing Sheets

(51) Int. Cl.
*E21B 10/42* (2006.01)
*E21B 17/10* (2006.01)

(56) References Cited

U.S. PATENT DOCUMENTS

| | | | | |
|---|---|---|---|---|
| 5,678,645 | A | 10/1997 | Tibbitts et al. | |
| 5,906,245 | A | 5/1999 | Tibbitts et al. | |
| 6,283,234 | B1 | 9/2001 | Torbet | |
| 7,533,739 | B2 | 5/2009 | Cooley et al. | |
| 7,942,218 | B2 | 5/2011 | Cooley et al. | |
| 8,499,859 | B1 | 8/2013 | Cooley et al. | |
| 8,528,670 | B1 | 9/2013 | Cooley et al. | |
| 8,567,533 | B2 | 10/2013 | Myers et al. | |
| 9,551,190 | B2 | 1/2017 | Hiwasa et al. | |
| 9,976,353 | B2 * | 5/2018 | Hinz | E21B 10/43 |
| 2008/0053709 | A1 | 3/2008 | Lockstedt et al. | |
| 2009/0205870 | A1 | 8/2009 | Smith | |
| 2010/0314176 | A1 | 12/2010 | Zhang et al. | |
| 2011/0073376 | A1 * | 3/2011 | Radford | E21B 10/322 175/269 |
| 2012/0111630 | A1 * | 5/2012 | Chen | E21B 10/43 175/45 |
| 2014/0054094 | A1 * | 2/2014 | Burhan | E21B 10/50 175/354 |
| 2014/0174827 | A1 | 6/2014 | Schen et al. | |
| 2016/0273273 | A1 * | 9/2016 | Hinz | E21B 10/43 |

FOREIGN PATENT DOCUMENTS

| | | | | |
|---|---|---|---|---|
| WO | 2012-149120 | | 11/2012 | |
| WO | WO-2013074898 | A1 * | 5/2013 | E21B 10/567 |

OTHER PUBLICATIONS

International Preliminary Report on Patentability for PCT Patent Application No. PCT/US2015-031038, dated Apr. 20, 2017; 11 pages.

Office Action for Canadian Patent Application No. 2958189, dated Jan. 11, 2018; 3 pages.

Office Action for Chinese Patent Application No. 201580048200.7, dated Jun. 27, 2018; 13 pages.

Office Action for Canadian Patent Application No. 2958189, dated Oct. 11, 2018; 4 pages.

* cited by examiner

SECURING MECHANISM FOR A DRILLING ELEMENT ON A DOWNHOLE DRILLING TOOL

RELATED APPLICATIONS

This application is a U.S. National Stage Application of International Application No. PCT/US2015/031038 filed May 15, 2015, which designates the United States, and claims the benefit of U.S. Provisional Application Ser. No. 62/060,401 filed on Oct. 6, 2014, which are incorporated herein by reference in their entirety.

TECHNICAL FIELD

The present disclosure relates generally to downhole drilling tools and, more particularly, to a securing mechanism for a drilling element on a downhole drilling tool.

BACKGROUND

Various types of tools are used to form wellbores in subterranean formations for recovering hydrocarbons such as oil and gas lying beneath the surface. Examples of such tools include rotary drill bits, hole openers, reamers, and coring bits. Two major categories of rotary drill bits include fixed cutter drill bits, some of which may be referred to in the art as polycrystalline diamond compact (PDC) drill bits, drag bits, or matrix drill bits; and roller cone drill bits, some of which may be referred to in the art as rock bits. A fixed cutter drill bit typically includes multiple blades each having multiple cutters, such as the PDC cutters on a PDC bit.

In typical drilling applications, a rotary drill bit may be used to drill through various levels or types of geological formations. Typical formations may generally have a relatively low compressive strength in the upper portions (e.g., lesser drilling depths) of the formation and a relatively high compressive strength in the lower portions (e.g., greater drilling depths) of the formation. Thus, it typically becomes increasingly more difficult to drill at increasingly greater depths. Further, during drilling operations, the cutters of a drill bit may experience wear. Cutters that incur excessive wear may be removed from a drill bit and may be replaced by either new or refurbished cutters for further drilling.

BRIEF DESCRIPTION OF THE DRAWINGS

For a more complete understanding of the present disclosure and its features and advantages, reference is now made to the following description, taken in conjunction with the accompanying drawings, in which.

DETAILED DESCRIPTION

Figure 1:
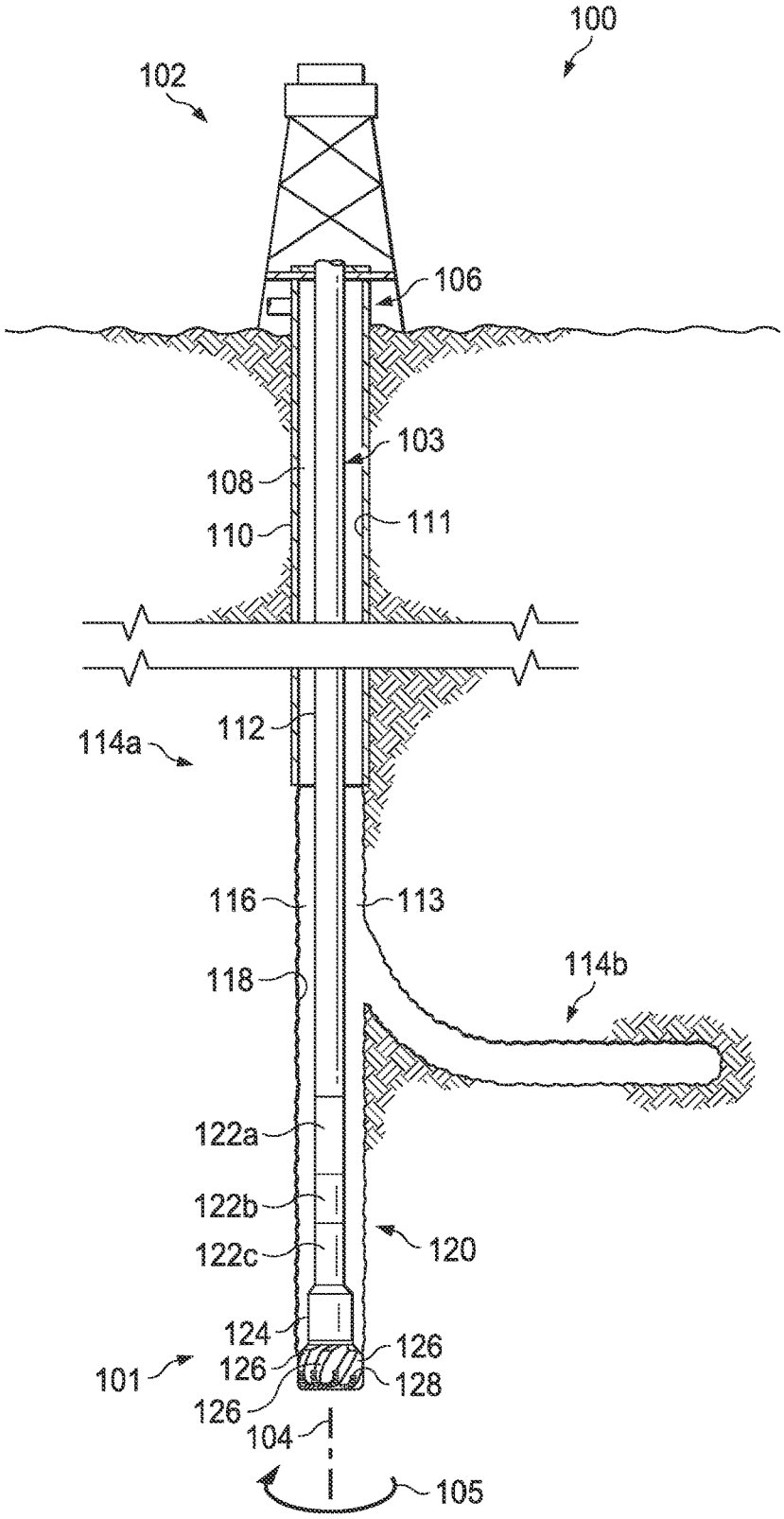
FIG. 1 illustrates an elevation view of an example embodiment of a drilling system.

A downhole drilling tool and related systems and methods for securing a drilling element on the downhole drilling tool are disclosed. Downhole drilling tools, such as drill bits, reamers, and stabilizers may include various drilling elements. A drilling element may be a feature that is coupled to a downhole drilling tool and that engages the formation during drilling operations.

One example of a drilling element is a cutting element, which is located on a drill bit, and which interacts with and cuts into a formation during drilling operations. A cutting element may include a substrate with a layer of hard cutting material disposed on one end of the substrate. The hard layer of a cutting element may provide a cutting surface that may engage adjacent portions of a downhole formation to form a wellbore during drilling operations.

Another example of a drilling element is a depth of cut controller (DOCC). A DOCC may be located on a drill bit and may interact with a formation during drilling operations in a manner that controls the depth of cut of one or more cutting elements. A DOCC may include an impact arrestor, a back-up cutting element, or a Modified Diamond Reinforcement (MDR).

Another example of a drilling element is a rolling element. A rolling element may be secured to a downhole drilling tool and may include a rotatably mounted roller. The roller may include an outer layer of hardened material that engages the formation during drilling operations. As described in further detail below with reference to FIGS. 12A and 12B, rolling elements may serve different functions depending on their orientation on a downhole drilling tool. For example, a rolling element may be oriented on a drill bit to cut into a formation during drilling operation. A rolling element may also be oriented on a drill bit to serve as a DOCC controlling the depth of cut for other cutting elements. As another example, a rolling element may be oriented on a reamer or a stabilizer to reduce the amount of friction between the reamer or stabilizer and the sidewall of a wellbore during drilling operations.

Drilling elements may be secured to a downhole drilling tool by a locking element. As an example, a cutting element may be secured, within a pocket on a blade of a drill bit, by a locking element. During drilling operations, the cutting element may experience a drag force due to the interaction of the cutting element with the formation being cut as the drill bit rotates, and an axial force that corresponds generally with the weight on bit (WOB) that pushes the drill bit downhole. In some drill bits, the cutting element may be disposed in the pocket such that the pocket provides support for the cutting element against the drag force and the axial force. However, due to the forces applied to the cutting element (e.g., the drag force and the axial force), the cutting element may also experience a reactive moment force tending to rotate the cutting element out of the pocket about a point on the back of the cutting element. A locking element may support the cutting element against such a moment force, and may thus secure the cutting element in the pocket during drilling. Other type of drilling elements (e.g., DOCCs or rolling elements) may also be secured to a downhole drilling tool by a locking element in a similar manner.

Drilling elements may also be designed such that the drilling elements may be replaced after incurring wear during drilling operations. As described directly above, a cutting element may be designed to fit within a pocket formed on a blade of a drill bit. A locking element may secure the cutting element in the pocket during drilling operations. Further, the locking element may be directly accessible from the surface of a blade in which the pocket is located. As such, the locking element may be easily removed, allowing for easy removal and replacement of the cutting element between drilling operations. Such locking elements may also be utilized to allow for the easy removal and replacement of other types of drilling elements (e.g., DOCCs or rolling elements).

There are numerous ways in which a locking element may be implemented to secure a drilling element on a downhole drilling tool. Moreover, a locking element may be implemented to secure any suitable drilling element (e.g., a cutting element, a DOCC, or a rolling element) on any suitable downhole drilling tool (e.g., a drill bit, a reamer, or a stabilizer) which may be part of a bottom hole assembly (BHA) such as BHA 120 described in further detail below with reference to FIG. 1. Thus, embodiments of the present disclosure and its advantages are best understood by referring to FIGS. 1 through 12B, where like numbers are used to indicate like and corresponding parts.

FIG. 1 illustrates an elevation view of an example embodiment of drilling system 100. Drilling system 100 may include well surface or well site 106. Various types of drilling equipment such as a rotary table, drilling fluid pumps and drilling fluid tanks (not expressly shown) may be located at well surface or well site 106. For example, well site 106 may include drilling rig 102 that may have various characteristics and features associated with a land drilling rig. However, downhole drilling tools incorporating teachings of the present disclosure may be satisfactorily used with drilling equipment located on offshore platforms, drill ships, semi-submersibles and drilling barges (not expressly shown).

Drilling system 100 may also include drill string 103 associated with drill bit 101 that may be used to form a wide variety of wellbores or bore holes such as generally vertical wellbore 114*a* or generally horizontal wellbore 114*b* or any combination thereof. Various directional drilling techniques and associated components of bottom hole assembly (BHA) 120 of drill string 103 may be used to form horizontal wellbore 114*b*. For example, lateral forces may be applied to BHA 120 proximate kickoff location 113 to form generally horizontal wellbore 114*b* extending from generally vertical wellbore 114*a*.

BHA 120 may include a variety of components that may be recruited during the process of drilling the wellbore 114. For example, components 122*a*, 122*b* and 122*c* of BHA 120 may include, but are not limited to, drill bits (e.g., drill bit 101), coring bits, drill collars, rotary steering tools, directional drilling tools, downhole drilling motors, reamers, hole enlargers or stabilizers. The number and types of components 122 included in BHA 120 may depend on anticipated downhole drilling conditions and the type of wellbore that will be formed by drill string 103 and rotary drill bit 101. BHA 120 may also include various types of well logging tools (not expressly shown) and other downhole tools associated with directional drilling of a wellbore. Examples of logging tools and/or directional drilling tools may include, but are not limited to, acoustic, neutron, gamma ray, density, photoelectric, nuclear magnetic resonance, rotary steering tools and/or any other commercially available well tool. Further, BHA 120 may also include a rotary drive (not expressly shown) connected to components 122*a*, 122*b* and 122*c* and which rotates at least part of drill string 103 together with components 122*a*, 122*b* and 122*c*.

Wellbore 114 may be defined in part by casing string 110 that may extend from well surface 106 to a selected downhole location. Portions of wellbore 114, as shown in FIG. 1, that do not include casing string 110 may be described as open hole. Various types of drilling fluid may be pumped from well surface 106 through drill string 103 to attached drill bit 101. The drilling fluids may be directed to flow from drill string 103 to respective nozzles (depicted as nozzles 156 in FIG. 2) passing through rotary drill bit 101. The drilling fluid may be circulated back to well surface 106 through annulus 108 defined in part by outside diameter 112 of drill string 103 and inside diameter 118 of wellbore 114*a*. Inside diameter 118 may be referred to as the sidewall of wellbore 114*a*. Annulus 108 may also be defined by outside diameter 112 of drill string 103 and inside diameter 111 of casing string 110. Open hole annulus 116 may be defined as sidewall 118 and outside diameter 112.

Drilling system 100 may also include rotary drill bit ("drill bit") 101. Drill bit 101, discussed in further detail in FIG. 2, may include one or more blades 126 that may be disposed outwardly from exterior portions of rotary bit body 124 of drill bit 101. Blades 126 may be any suitable type of projections extending outwardly from rotary bit body 124. Drill bit 101 may rotate with respect to bit rotational axis 104 in a direction defined by directional arrow 105. Blades 126 may include one or more cutting elements 128 disposed outwardly from exterior portions of each blade 126. Blades 126 may also include one or more depth of cut controllers (not expressly shown) configured to control the depth of cut of cutting elements 128. Blades 126 may further include one or more gage pads (not expressly shown) disposed on blades 126. Drill bit 101 may be designed and formed in accordance with teachings of the present disclosure and may have many different designs, configurations, and/or dimensions according to the particular application of drill bit 101.

The configuration of cutting elements 128 on drill bit 101 and/or other downhole drilling tools may also contribute to the drilling efficiency of the drill bit. Cutting elements 128 may be laid out according to two general principles: single-set and track-set. In a single-set configuration, each of cutting elements 128 on drill bit 101 may have a unique radial position with respect to bit rotational axis 104. In a track-set configuration, at least two of cutting elements 128 of drill bit 101 may have the same radial position with respect to bit rotational axis 104. Track-set cutting elements may be located on different blades of the drill bit. Drill bits having cutting elements laid out in a single-set configuration may drill more efficiently than drill bits having a track-set configuration while drill bits having cutting elements laid out in a track-set configuration may be more stable than drill bits having a single-set configuration.

Figure 2:
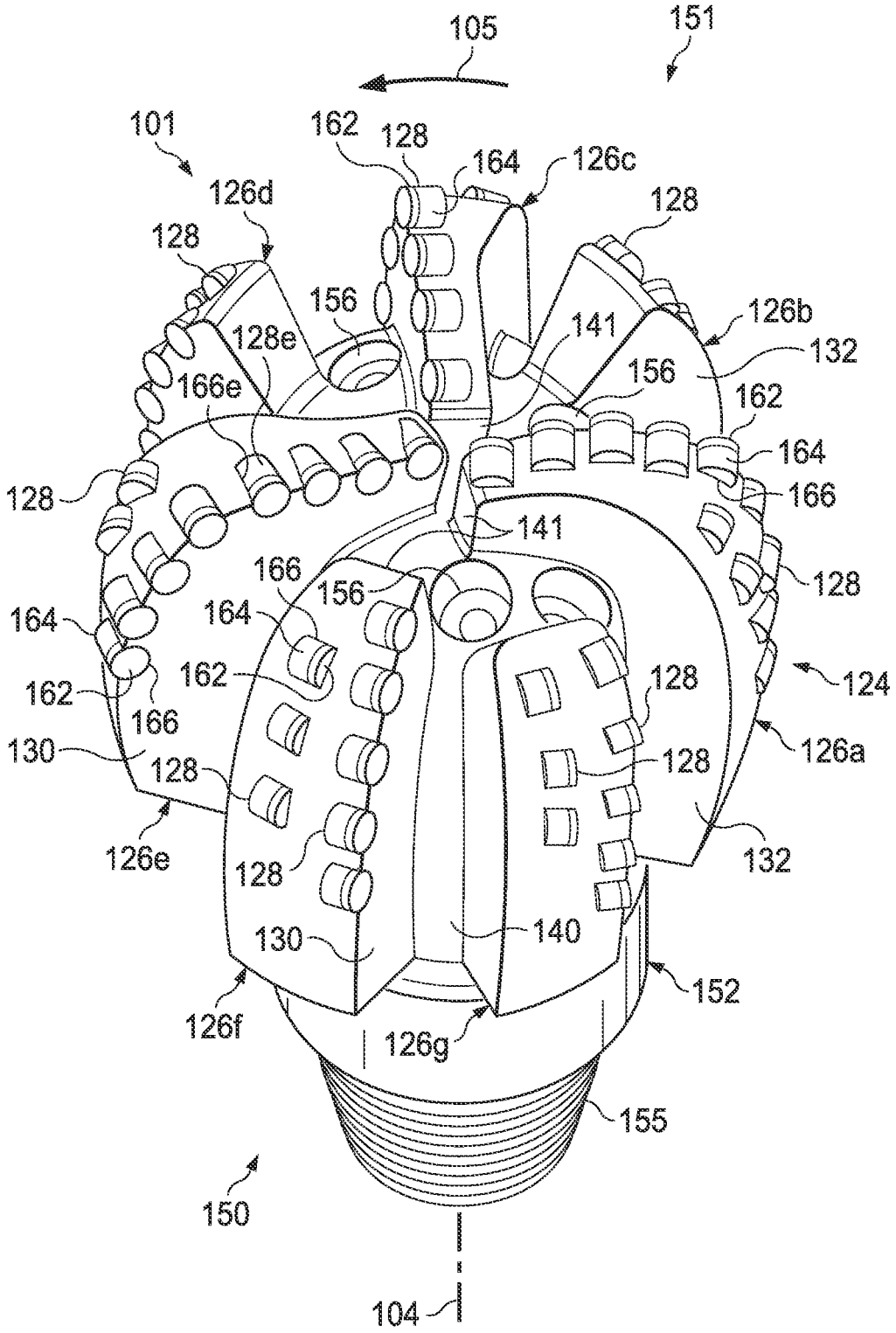
FIG. 2 illustrates an isometric view of a rotary drill bit oriented upwardly in a manner often used to model or design fixed cutter drill bits.

FIG. 2 illustrates an isometric view of rotary drill bit 101 oriented upwardly in a manner often used to model or design fixed cutter drill bits. Drill bit 101 may be any of various types of rotary drill bits, including fixed cutter drill bits, polycrystalline diamond compact (PDC) drill bits, drag bits, matrix drill bits, and/or steel body drill bits operable to form a wellbore (e.g., wellbore 114 as illustrated in FIG. 1) extending through one or more downhole formations. Drill bit 101 may be designed and formed in accordance with teachings of the present disclosure and may have many different designs, configurations, and/or dimensions according to the particular application of drill bit 101.

Drill bit 101 may include one or more blades 126 (e.g., blades 126*a*-126*g*) that may be disposed outwardly from exterior portions of rotary bit body 124 of drill bit 101. Blades 126 may be any suitable type of projections extending outwardly from rotary bit body 124. For example, a portion of blade 126 may be directly or indirectly coupled to an exterior portion of bit body 124, while another portion of blade 126 may be projected away from the exterior portion of bit body 124. Blades 126 formed in accordance with teachings of the present disclosure may have a wide variety of configurations including, but not limited to, substantially arched, generally helical, spiraling, tapered, converging, diverging, symmetrical, and/or asymmetrical. One or more blades 126 may have a substantially arched configuration extending from proximate rotational axis 104 of drill bit 101. The arched configuration may be defined in part by a generally concave, recessed shaped portion extending from proximate bit rotational axis 104. The arched configuration may also be defined in part by a generally convex, outwardly curved portion disposed between the concave, recessed portion and exterior portions of each blade which correspond generally with the outside diameter of the rotary drill bit.

Each of blades 126 may include a first end disposed proximate or toward bit rotational axis 104 and a second end disposed proximate or toward exterior portions of drill bit 101 (e.g., disposed generally away from bit rotational axis 104 and toward uphole portions of drill bit 101). The terms uphole and downhole may be used to describe the location of various components of drilling system 100 relative to the bottom or end of wellbore 114 shown in FIG. 1. For example, a first component described as uphole from a second component may be further away from the end of wellbore 114 than the second component. Similarly, a first component described as being downhole from a second component may be located closer to the end of wellbore 114 than the second component.

Blades 126*a*-126*g* may include primary blades disposed about the bit rotational axis. For example, blades 126*a*, 126*c*, and 126*e* may be primary blades or major blades because respective first ends 141 of each of blades 126*a*, 126*c*, and 126*e* may be disposed closely adjacent to bit rotational axis 104 of drill bit 101. Blades 126*a*-126*g* may also include at least one secondary blade disposed between the primary blades. For example, as illustrated in FIG. 2, blades 126*b*, 126*d*, 126*f*, and 126*g* on drill bit 101 may be secondary blades or minor blades because respective first ends 141 may be disposed on downhole end 151 of drill bit 101 a distance from associated bit rotational axis 104. The number and location of primary blades and secondary blades may vary such that drill bit 101 includes more or less primary and secondary blades. Blades 126 may be disposed symmetrically or asymmetrically with regard to each other and bit rotational axis 104 where the location of blades 126 may be based on the downhole drilling conditions of the drilling environment. Blades 126 and drill bit 101 may rotate about rotational axis 104 in a direction defined by directional arrow 105.

Each of blades 126 may have respective leading or front surfaces 130 in the direction of rotation of drill bit 101 and trailing or back surfaces 132 located opposite of leading surface 130 away from the direction of rotation of drill bit 101. Blades 126 may be positioned along bit body 124 such that they have a spiral configuration relative to bit rotational axis 104. Blades 126 may also be positioned along bit body 124 in a generally parallel configuration with respect to each other and bit rotational axis 104.

Blades 126 may include one or more cutting elements 128 disposed outwardly from exterior portions of each blade 126. For example, a portion of cutting element 128 may be directly or indirectly coupled to an exterior portion of blade 126 while another portion of cutting element 128 may be projected away from the exterior portion of blade 126.

Cutting elements 128 may be any suitable device configured to cut into a formation, including but not limited to, primary cutting elements, back-up cutting elements, secondary cutting elements or any combination thereof. Cutting elements 128 may include respective substrates 164 with a layer of hard cutting material (e.g., cutting table 162) disposed on one end of each respective substrate 164. The hard layer of cutting elements 128 may provide a cutting surface that may engage adjacent portions of a downhole formation to form wellbore 114 as illustrated in FIG. 1. By way of example and not limitation, cutting elements 128 may be various types of cutters, compacts, buttons, inserts, and gage cutters satisfactory for use with a wide variety of drill bits 101. Although FIG. 2 illustrates two rows of cutting elements 128 on blades 126, drill bits designed and manufactured in accordance with the teachings of the present disclosure may have one row of cutting elements or more than two rows of cutting elements.

Each substrate 164 of cutting elements 128 may have various configurations and may be formed from tungsten carbide or other suitable materials associated with forming cutting elements for rotary drill bits. Tungsten carbides may include, but are not limited to, monotungsten carbide (WC), ditungsten carbide ($W_2C$), macrocrystalline tungsten carbide and cemented or sintered tungsten carbide. Substrates may also be formed using other hard materials, which may include various metal alloys and cements such as metal borides, metal carbides, metal oxides and metal nitrides. For some applications, the hard cutting layer may be formed from substantially the same materials as the substrate. In other applications, the hard cutting layer may be formed from different materials than the substrate. Examples of materials used to form hard cutting layers may include polycrystalline diamond materials, including synthetic polycrystalline diamonds.

During drilling operations, cutting elements 128 may experience a drag force due to the interaction of the cutting elements 128 with the formation being drilled as the drill bit rotates in direction 105 about bit rotational axis 104. Cutting elements 128 may also experience an axial force that corresponds generally with the weight on bit (WOB) that pushes the drill bit downhole. Cutting elements 128 may be supported against drag and axial forces by the pockets 166 in which they are placed on the respective blades 126. For example, blade 126*e* may include pocket 166*e* that may be a concave cutout on blade 126*e* configured to receive cutting element 128*e*. However, due to the forces applied to the cutting element (e.g., the drag force and the axial force), the cutting element may also experience a reactive moment force tending to rotate the cutting element out of the pocket about a point on the back of the cutting element. As described in further detail below with reference to FIGS. 4-12B, a locking element may support cutting element 128 against such a moment force, and may thus secure the cutting element in the pocket during drilling.

Blades 126 may also include one or more depth of cut controllers (DOCCs) (not expressly shown) configured to control the depth of cut of cutting elements 128. A DOCC may include an impact arrestor, a back-up or second layer cutting element, a Modified Diamond Reinforcement (MDR). Exterior portions of blades 126, cutting elements 128 and DOCCs (not expressly shown) may form portions of the bit face.

Blades 126 may further include one or more gage pads (not expressly shown) disposed on blades 126. A gage pad may be a gage, gage segment, or gage portion disposed on exterior portion of blade 126. Gage pads may contact adjacent portions of a wellbore (e.g., wellbore 114 as illustrated in FIG. 1) formed by drill bit 101. Exterior portions of blades 126 and/or associated gage pads may be disposed at various angles (e.g., positive, negative, and/or parallel) relative to adjacent portions of generally vertical wellbore 114*a*. A gage pad may include one or more layers of hardfacing material.

Uphole end 150 of drill bit 101 may include shank 152 with drill pipe threads 155 formed thereon. Threads 155 may be used to releasably engage drill bit 101 with BHA 120 whereby drill bit 101 may be rotated relative to bit rotational axis 104. Downhole end 151 of drill bit 101 may include a plurality of blades 126*a*-126*g* with respective junk slots or fluid flow paths 140 disposed therebetween. Additionally, drilling fluids may be communicated to one or more nozzles 156.

Drill bit operation may be expressed in terms of depth of cut per revolution as a function of drilling depth. Depth of cut per revolution, or "depth of cut," may be determined by rate of penetration (ROP) and revolution per minute (RPM). ROP may represent the amount of formation that is removed as drill bit 101 rotates and may be in units of ft/hr. Further, RPM may represent the rotational speed of drill bit 101. For example, drill bit 101 utilized to drill a formation may rotate at approximately 120 RPM. Actual depth of cut (Δ) may represent a measure of the depth that cutting elements cut into the formation during a rotation of drill bit 101. Thus, actual depth of cut may be expressed as a function of actual ROP and RPM using the following equation:

$$\Delta = ROP/(5*RPM).$$

Actual depth of cut may have a unit of in/rev.

The rate of penetration (ROP) of drill bit 101 is often a function of both weight on bit (WOB) and revolutions per minute (RPM). Drill string 103 may apply weight on drill bit 101 and may also rotate drill bit 101 about rotational axis 104 to form a wellbore 114 (e.g., wellbore 114*a* or wellbore 114*b*). For some applications a downhole motor (not expressly shown) may be provided as part of BHA 120 to also rotate drill bit 101.

Figure 3A:
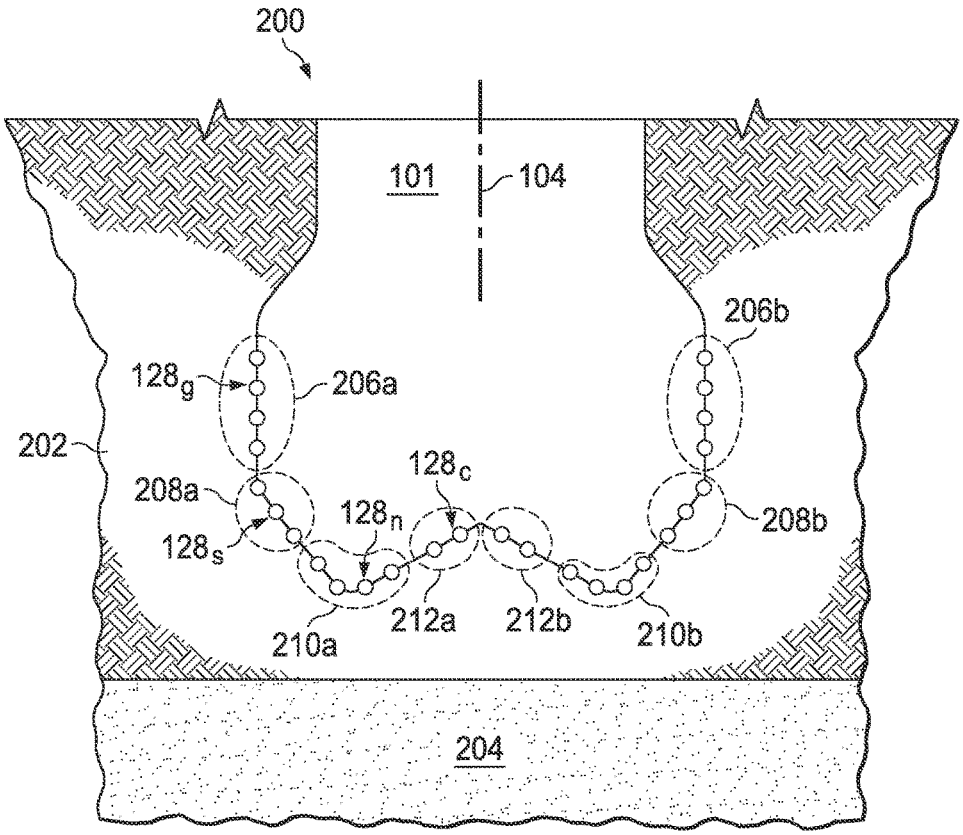
FIG. 3A illustrates a drawing in section and in elevation with portions broken away showing the drill bit of FIG. 2 drilling a wellbore through a first downhole formation and into an adjacent second downhole formation.

FIG. 3A illustrates a drawing in section and in elevation with portions broken away showing drill bit 101 of FIG. 2 drilling a wellbore through a first downhole formation and into an adjacent second downhole formation. Exterior portions of blades (not expressly shown in FIG. 3A) and cutting elements 128 may be projected rotationally onto a radial plane to form bit face profile 200. Formation layer 202 may be described as softer or less hard when compared to downhole formation layer 204. As shown in FIG. 3A, exterior portions of drill bit 101 that contact adjacent portions of a downhole formation may be described as a bit face. Bit face profile 200 of drill bit 101 may include various zones or segments. Bit face profile 200 may be substantially symmetric about bit rotational axis 104 due to the rotational projection of bit face profile 200, such that the zones or segments on one side of rotational axis 104 may be substantially similar to the zones or segments on the opposite side of rotational axis 104.

For example, bit face profile 200 may include a gage zone 206*a* located opposite a gage zone 206*b*, a shoulder zone 208*a* located opposite a shoulder zone 208*b*, a nose zone 210*a* located opposite a nose zone 210*b*, and a cone zone 212*a* located opposite a cone zone 212*b*. The cutting elements 128 included in each zone may be referred to as cutting elements of that zone. For example, cutting elements $\mathbf{128}_g$ included in gage zones 206 may be referred to as gage cutting elements, cutting elements $\mathbf{128}_s$ included in shoulder zones 208 may be referred to as shoulder cutting elements, cutting elements $\mathbf{128}_n$ included in nose zones 210 may be referred to as nose cutting elements, and cutting elements $\mathbf{128}_c$ included in cone zones 212 may be referred to as cone cutting elements.

Cone zones 212 may be generally concave and may be formed on exterior portions of each blade (e.g., blades 126 as illustrated in FIG. 1) of drill bit 101, adjacent to and extending out from bit rotational axis 104. Nose zones 210 may be generally convex and may be formed on exterior portions of each blade of drill bit 101, adjacent to and extending from each cone zone 212. Shoulder zones 208 may be formed on exterior portions of each blade 126 extending from respective nose zones 210 and may terminate proximate to a respective gage zone 206. As shown in FIG. 3A, the area of bit face profile 200 may depend on cross-sectional areas associated with zones or segments of bit face profile 200 rather than on a total number of cutting elements, a total number of blades, or cutting areas per cutting element.

Figure 3B:
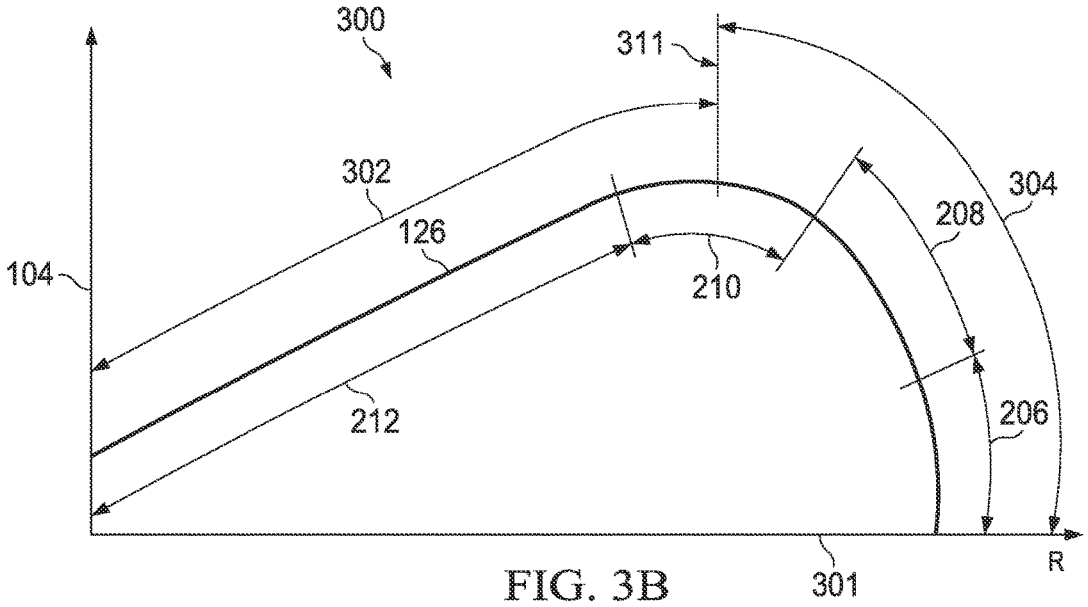
FIG. 3B illustrates a blade profile that represents a cross-sectional view of a blade of a drill bit.

FIG. 3B illustrates blade profile 300 that represents a cross-sectional view of blade 126 of drill bit 101. Blade profile 300 includes cone zone 212, nose zone 210, shoulder zone 208 and gage zone 206 as described above with respect to FIG. 2. Cone zone 212, nose zone 210, shoulder zone 208 and gage zone 206 may be based on their location along blade 126 with respect to rotational axis 104 and horizontal reference line 301 that indicates a distance from rotational axis 104 in a plane perpendicular to rotational axis 104. A comparison of FIGS. 3A and 3B shows that blade profile 300 of FIG. 3B is upside down with respect to bit face profile 200 of FIG. 3A.

Blade profile 300 may include inner zone 302 and outer zone 304. Inner zone 302 may extend outward from rotational axis 104 to nose point 311. Outer zone 304 may extend from nose point 311 to the end of blade 126. Nose point 311 may be the location on blade profile 300 within nose zone 210 that has maximum elevation as measured by bit rotational axis 104 (vertical axis) from reference line 301 (horizontal axis). A coordinate on the graph in FIG. 3B corresponding to rotational axis 104 may be referred to as an axial coordinate or position. A coordinate on the graph in FIG. 3B corresponding to reference line 301 may be referred to as a radial coordinate or radial position that may indicate a distance extending orthogonally from rotational axis 104 in a radial plane passing through rotational axis 104. For example, in FIG. 3B rotational axis 104 may be placed along a z-axis and reference line 301 may indicate the distance (R) extending orthogonally from rotational axis 104 to a point on a radial plane that may be defined as the ZR plane.

FIGS. 3A and 3B are for illustrative purposes only and modifications, additions or omissions may be made to FIGS. 3A and 3B without departing from the scope of the present disclosure. For example, the actual locations of the various zones with respect to the bit face profile may vary and may not be exactly as depicted.

Figure 4:
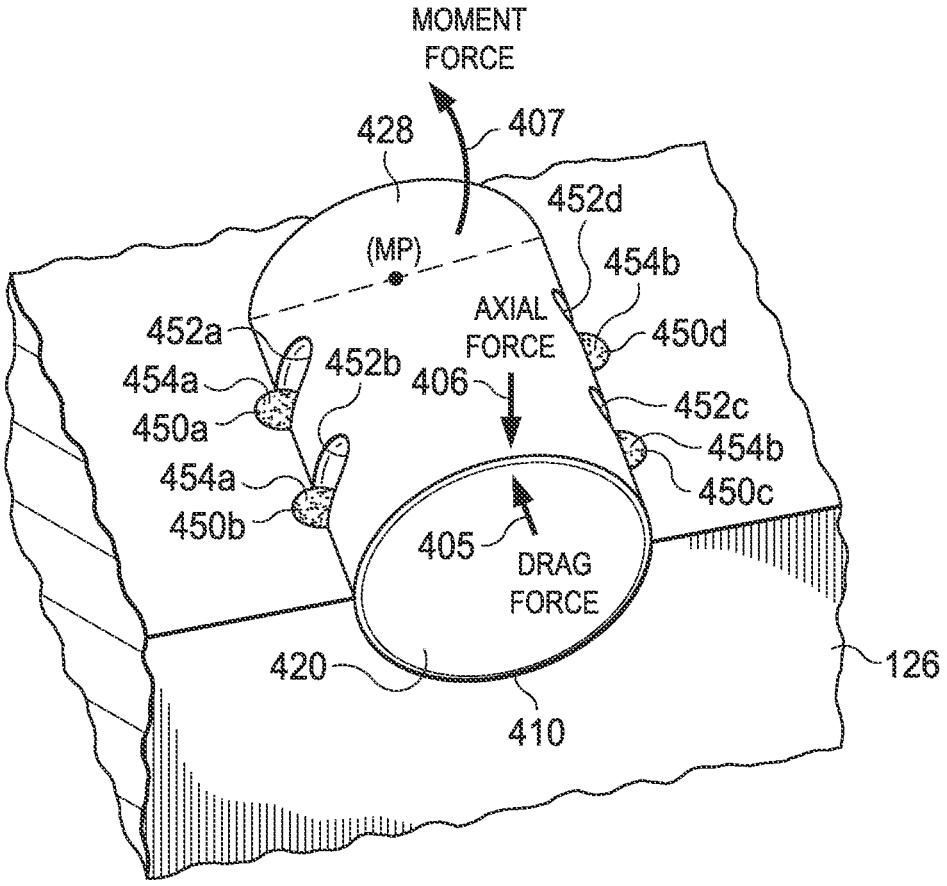
FIG. 4 illustrates an isometric view of an exemplary cutting element and a blade oriented upwardly.

FIG. 4 illustrates an isometric view of cutting element 428 and blade 126. Cutting element 428 and blade 126 are oriented upwardly similar to the upward orientation of cutting elements 128 located on blades 126*a-e* as shown in FIG. 2.

As shown in FIG. 4, cutting element 428 may be located in pocket 410 of blade 126. Consistent with FIG. 4, cutting elements (or other types of drilling elements such DOCCs or rolling elements) that are at least partially enclosed by a pocket (e.g., pocket 410) may be referred to herein as being located in the pocket.

During drilling operations, a drill bit on which blade 126 and cutting element 428 are located may rotate about a bit rotational axis, similar to the manner in which the elements of drill bit 101 in FIG. 2 may rotate around bit rotational axis 104. Accordingly, cutting elements 428 may experience drag force 405 due to an interaction between cutting face 420 and the formation being drilled as the drill bit, on which cutting element 428 is located, rotates. Cutting element 428 may also experience axial force 406 that corresponds generally with the weight on bit (WOB) that pushes the drill bit, on which cutting element 428 is located, downhole. As shown in FIG. 4, pocket 410 may support cutting element 428 against drag force 405 and axial force 406, and accordingly may contribute to securing cutting element 428 within pocket 410.

Due to the forces asserted on cutting element 428 (e.g., drag force 405 and axial force 406), cutting element 428 may also experience a reactive moment force 407 tending to rotate the cutting element out of the pocket about a moment point (MP) on the back of the cutting element. However, locking element 454 may support cutting element 428 against moment force 407, and accordingly may contribute to securing cutting element 428 within pocket 410.

Locking element 454 may extend inward from one set of corresponding blade and cutting-element openings and loop around to another set of corresponding blade and cutting-element openings. For example, locking element 454*a* may form a loop that extends inward from blade opening 450*a* and cutting-element opening 452*a* on a first end, and from blade opening 450*b* and cutting-element opening 452*b* on another end. Further, either a single or multiple locking elements 454 may secure a single cutting element on blade 126. For example, locking element 454*a* may form a loop on one side of cutting element 428 that extends inward from blade opening 450*a* and cutting-element opening 452*a* on a first end, and from blade opening 450*b* and cutting-element opening 452*b* on another end. Likewise, locking element 454*b* may form a loop on another side of cutting element 428 that extends inward from blade opening 450*c* and cutting-element opening 452*c* on a first end, and from blade opening 450*d* and cutting-element opening 452*d* on another end. As explained in further detail below with reference to FIGS. 5A-5D, locking elements such as locking element 454 may extend inward from openings in the blade and the cutting element through a cavity that is formed by a combined area between aligning grooves in the pocket and in the cutting element.

Figure 5A:
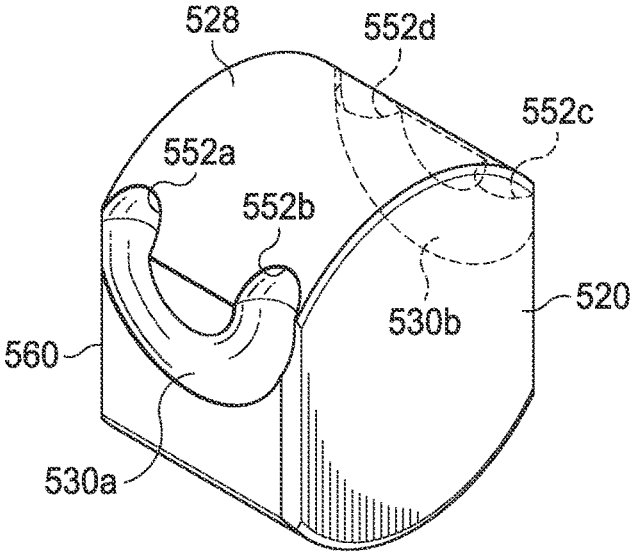
FIG. 5A illustrates an isometric view of an exemplary cutting element.
Figure 5B:
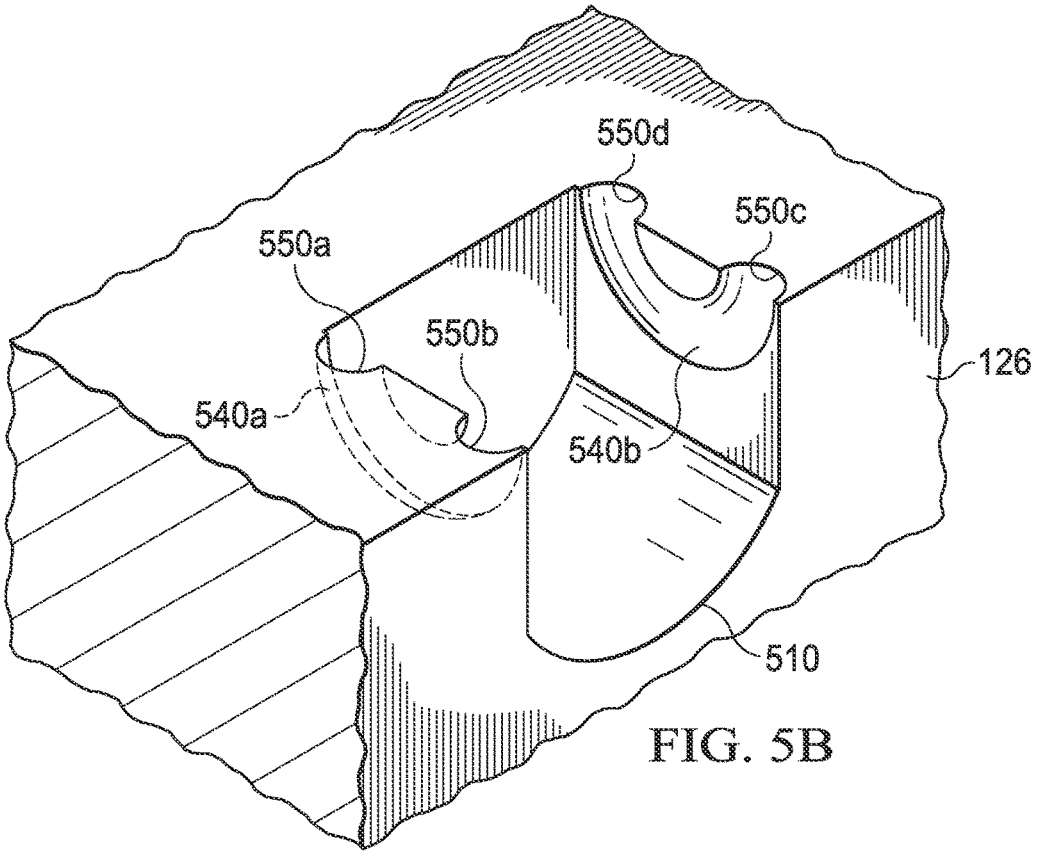
FIG. 5B illustrates an upwardly pointed isometric view of a portion of an exemplary blade that includes a pocket configured to receive the cutting element of FIG. 5A.
Figure 5C:
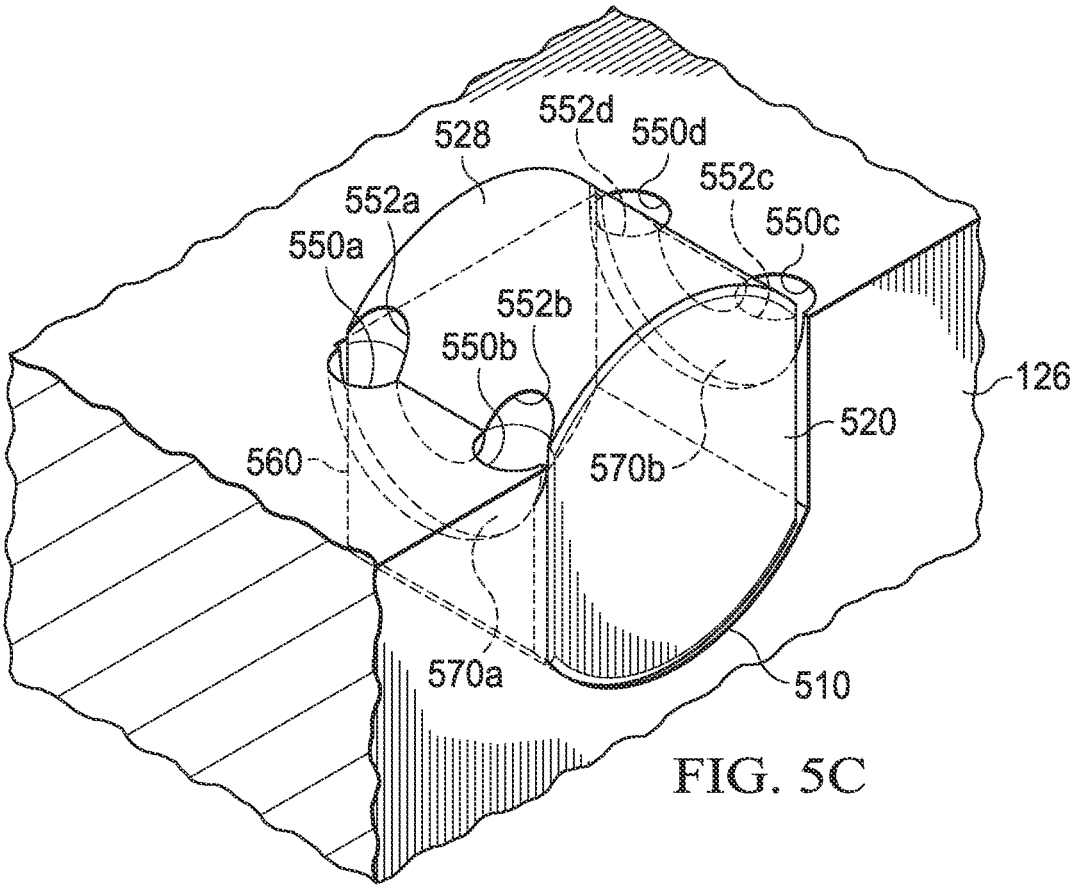
FIG. 5C illustrates an isometric view of the cutting element of FIG. 5A placed in the pocket of FIG. 5B.
Figure 5D:
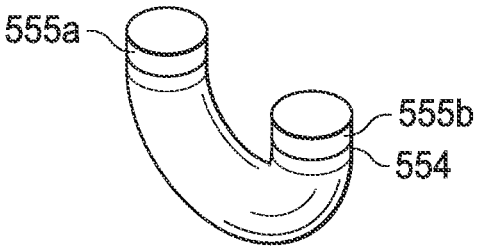
FIG. 5D illustrates an isometric view of an exemplary locking element configured to lock cutting element of FIG. 5A in the pocket of FIG. 5B.

FIG. 5A illustrates an isometric view of cutting element 528. FIG. 5B illustrates an upwardly pointed isometric view of a portion of blade 126 that includes pocket 510, which may be configured to receive cutting element 528 (shown in FIG. 5A). FIG. 5C illustrates an isometric view of cutting element 528 placed in pocket 510. And FIG. 5D illustrates locking element 554, which may secure cutting element 528 (shown in FIG. 5A) in pocket 510 (shown in FIG. 5B).

As shown in FIG. 5A, cutting element 528 may include cutting-element groove 530*a*, which may extend in a "U" shape from cutting-element opening 552*a* to cutting-element opening 552*b*. Cutting element 528 may also include cutting-element groove 530*b*, which may extend in a "U" shape from cutting-element opening 552*c* to cutting-element opening 552*d*. Although grooves included on cutting element 528 are referred to herein as cutting-element grooves, such grooves on cutting elements or other types of drilling elements (e.g., DOCCs or rolling elements) may also be referred to generally as drilling-element grooves.

As shown in FIG. 5B, blade 126 may include pocket groove 540*a*, which may adjoin pocket 510, and which may extend in a "U" shape from pocket opening 550*a* to pocket opening 550*b*. Blade 126 may also include pocket groove 540*b*, which may adjoin pocket 510, and which may extend in a "U" shape from pocket opening 550*c* to pocket opening 550*d*.

As shown in FIG. 5C, cutting element 528 may be placed into pocket 510. Further, one or more grooves of cutting element 528 may align with one or more grooves of blade 126. For example, cutting-element groove 530*a* (shown in FIG. 5A) and pocket groove 540*a* (shown in FIG. 5B) may align when cutting element 528 is placed in pocket 510, and may form cavity 570*a* (shown in FIG. 5C) in the combined space inside cutting-element groove 530*a* and pocket groove 540*a*. Likewise, cutting-element groove 530*b* (shown in FIG. 5A) and pocket groove 540*b* (shown in FIG. 5B) may align when cutting element 528 is placed in pocket 510, and may form cavity 570*b* (shown in FIG. 5C) in the combined space inside cutting-element groove 530*b* and pocket groove 540*b*. Although pocket grooves 540*a-b* and cutting-element grooves 530*a-b* are illustrated in FIGS. 5A-B as having "U" shapes, the respective grooves may have any suitable shape, such as a "U" shape with ninety-degree angles, a "V" shape, an arc or semi-circle shape, or a polygon shape.

With cutting element 528 placed in pocket 510, cutting element 528 may be secured or locked into place by locking element 554, shown in FIG. 5D. For example, an instance of locking element 554 may fit in respective cavities formed by each aligning pair of cutting-element and pocket grooves. For example, a first instance of locking element 554 may be placed in cavity 570*a* formed by cutting-element groove 530*a* and pocket groove 540*a*, and a second instance of locking element 554 may be placed in cavity 570*b* formed by cutting-element groove 530*b* and pocket groove 540*b*. Although cutting element 528 and blade 126 may be illustrated in FIGS. 5A-B as having two sets of pocket and cutting-element grooves, cutting element 528 and blade 126 may include only a single set of corresponding grooves, and cutting element 528 may be secured in pocket 510 with a single instance of locking element 554.

As shown in FIG. 5A, cutting element 528 may have a generally circular shape but with a flattened side 560. The flattened side 560 of cutting element may reduce the overall width of cutting element 528, and of pocket 510 in which cutting element 528 may be placed. The reduced width of cutting element 528 may provide additional space on blade 126 for pocket grooves 540*a* and 540*b*, while still adhering to spacing requirements for multiple instantiations of cutting element 528 on blade 126. Cutting elements, such as cutting element 528, may also have any other suitable shapes, for example a generally square shape, or a generally oval shape.

Locking element 554 may have any suitable shape, and may include any suitable material, to allow locking element 554 to be placed between a cutting-element groove (e.g., cutting-element groove 530*a*) and a pocket groove (e.g., pocket groove 540*a*). For example, locking element 554 may include a locking ring. A locking ring may have, for example, an arc shape or a semi-circle shape. A locking ring may be configured to be rotated through a corresponding arc shape or semi-circle shape formed by cutting-element groove 530*a* and pocket groove 540*a*. A locking ring may be formed by a rigid material such that the locking ring maintains its shape (e.g., arc or semi-circle shape) as the locking ring is inserted into cavity 570 formed by the combination of an instance of cutting-element groove 530 and an instance of pocket groove 540. Although such a locking element may be referred to as a locking ring, such a locking element may not form a full ring, but may rather form a portion of a ring.

As another example, locking element 554 may include a locking wire. Such a locking wire may be inserted into cavity 570 formed by an instance of cutting-element groove 530 and a corresponding instance of pocket groove 540. The locking wire may be formed by a malleable material such that the locking wire takes the shape of the cavity formed by a cutting-element groove and a pocket groove as the locking wire is inserted into the cavity.

Locking element 554 may include any suitable material to take the shape of cavity 570 formed by an instance of cutting-element groove 530 and a corresponding instance of pocket groove 540. For example, locking element 554 may include low-temperature metal, shaped memory metal, and/or spring steel. Locking element 554 may also include an array of ball bearings, or an array of any other suitable spherical and/or segmented elements, that may by placed into cavity 570. In addition, locking element 554 may include a liquid epoxy, an elastomer, a ceramic material, or a plastic material, that may be injected into cavity 570. The liquid epoxy may be used alone, or in combination with any other materials, such as a metal locking ring or a metal locking wire. Locking element 554 may also include an adhesive, which may fill any void in cavity 570 that is not already filled, for example, by a locking ring, a locking wire, or an array of ball bearings.

Locking element 554 may further include an instance of locking cap 555 at one or more ends of locking element 554. Locking cap 555 may plug cavity 570, in which locking element 554 is placed, and may keep locking element 554 in place in cavity 570 during drilling operations. Locking cap 555 may include a pressed cap, a threaded plug, a braze, an epoxy, or any other suitable means to protect locking element 554 from adverse elements or prevent tampering. Although locking cap 555 is described above as part of locking element 554, locking caps such as locking cap 555 may be either a part of, or a separate element from, the locking element being capped.

Cutting-element groove 530, pocket groove 540, and locking element 554 may provide for the easy removal and replacement of cutting element 528. As shown in FIGS. 5A-D, locking element 554 may form a loop that may be accessible from the surfaces of blade 126 and/or cutting element 528 at two separate points. The dual points of access formed by cutting-element groove 530*a* and pocket groove 540*a* may allow locking element 554 to be easily removed. For example, referring back to FIG. 4, locking caps at each of the two respective ends of locking element 454*a* may be removed. A force may be applied to one side of locking element 454*a* (e.g., at opening 450*a*) to push locking element 454*a* through the cavity formed by the pocket groove and the cutting-element groove. Locking element 454*a* may then be removed from the other side (e.g., at opening 450*b*). Locking element 454*b* may be removed in a similar manner as described for locking element 454*a*. Once locking elements 454*a* and 454*b* are removed, cutting element 428 may be removed and/or replaced by a new or refurbished cutting element.

The easy removal of locking element 554 may allow for the cutting elements of a drill bit (e.g., cutting element 528) to be easily replaced, for example, after those cutting elements have become worn due to extensive drilling. Moreover, locking element 554 may provide for a way to secure cutting elements into their respective pockets without utilizing a brazing process that impacts cutting face 520 of cutting element 528. The elimination of a brazing process to secure a cutting element to a blade of a drill bit may allow for the utilization of higher quality cutting elements that provide more efficient cutting during drilling operations. For example, the high temperature of a typical brazing process may limit the quality of the polycrystalline diamond material that may be used on a hard cutting surface of a PDC cutting element. Without the brazing process, a higher quality polycrystalline diamond material may be used on the hard cutting surface of the cutting element, and may thus provide for more efficient cutting during drilling operations, and for an extended service life of the cutting element.

Although locking element 554, as well as the corresponding cutting-element and pocket grooves, are described above as being formed in a "U" shape, locking elements and their corresponding cutting-element and pocket grooves may be formed in any suitable shape. For example, a locking element and its corresponding cutting-element and pocket grooves may form a helical shape around the cutting element. As another example, and as described in further detail below with reference to FIGS. 6A-B, a locking element may be formed in an "L" shape from a first end of the locking element to an opposing end of the locking element, with first end and opposing end accessible on separate surfaces of the blade and/or cutting element.

Figure 6A:
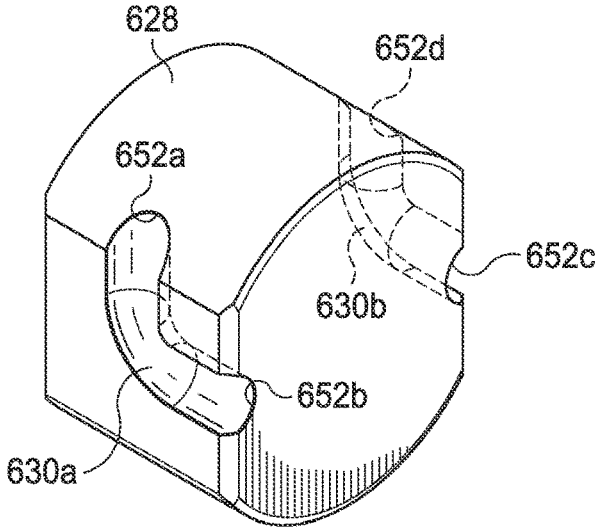
FIG. 6A illustrates an isometric view of an exemplary cutting element.
Figure 6B:
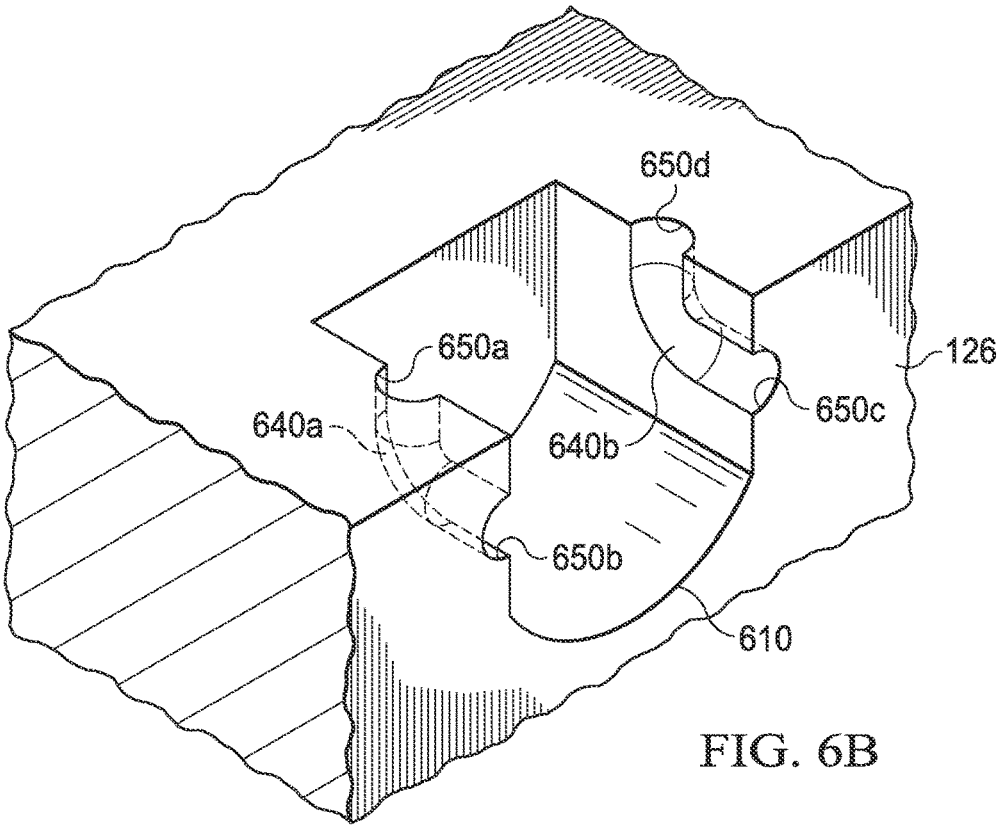
FIG. 6B illustrates an upwardly pointed isometric view of a portion of an exemplary blade that includes a pocket configured to receive the cutting element of FIG. 6A.

FIG. 6A illustrates an isometric view of cutting element 628. FIG. 6B illustrates an upwardly pointed isometric view of a portion of blade 126 that includes pocket 610, which may be configured to receive cutting element 628 (shown in FIG. 6A).

As shown in FIG. 6A, cutting element 628 may include cutting-element groove 630*a*, which may extend in an "L" shape from cutting-element opening 652*a* to cutting-element opening 652*b*. Cutting element 628 may also include cutting-element groove 630*b*, which may extend in an "L" shape from cutting-element opening 652*c* to cutting-element opening 652*d*.

As shown in FIG. 6B, blade 126 may include pocket groove 640*a*, which may adjoin pocket 610, and which may extend in an "L" shape from pocket opening 650*a* to pocket opening 650*b*. Blade 126 may also include pocket groove 640*b*, which may adjoin pocket 610, and which may extend in an "L" shape from pocket opening 650*c* to pocket opening 650*d*. Cutting element 628 may be placed into pocket 610. Further, one or more grooves of cutting element 628 may align with one or more pocket grooves of blade 126. For example, cutting-element groove 630*a* may align with pocket groove 640*a*, and cutting-element groove 630*b* may align with pocket groove 640*b*. With cutting element 628 placed in pocket 610, cutting element 628 may be secured or locked into place by one or more locking elements in a similar manner as described above with reference to the respective blade, cutting element, and locking element of FIGS. 5A-C.

Figure 7:
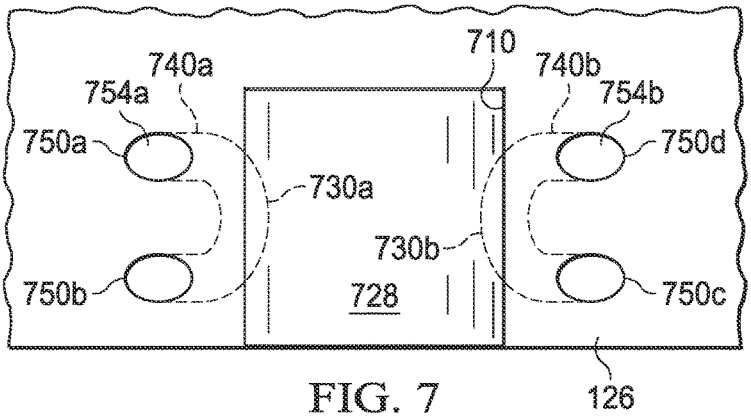
FIG. 7 illustrates a bottom view of a cutting element and a blade.

FIG. 7 illustrates a bottom view of cutting element 728 and blade 126. As shown in FIG. 7, one or more locking elements 754 may secure cutting element 728 into pocket 710 of blade 126. Moreover, one or more of the openings through which locking element 754 may be accessed may be fully encompassed within the surface of blade 126. For example, blade 126 may include pocket groove 740*a*, which may extend inward in a "U" shape from opening 750*a* to opposing opening 750*b*. Likewise, blade 126 may include pocket groove 740*b*, which may extend inward in a "U" shape from openings 750*c* and 750*d*.

Cutting element 728 may be placed in pocket 710 of blade 126. Cutting element 728 may include cutting-element groove 730*a* and cutting-element groove 730*b*. Pocket groove 740*a* may align with cutting-element groove 730*a*, and pocket groove 740*b* may align with cutting-element groove 730*b*. Cutting-element grooves 730*a* and 730*b* may be located underneath the exposed surface of cutting element 728, and may align with portions of pocket grooves 740*a* and 740*b* respectively that are located underneath the exposed surface of blade 126. Locking element 754*a* may be inserted to fill the cavity formed by the combination of pocket groove 740*a* and cutting-element groove 730*a*. Likewise, locking element 754*b* may be inserted to fill the cavity formed by the combination of pocket groove 740*b* and cutting-element groove 730*b*. With cutting element 728 placed in pocket 710, cutting element 728 may be secured or locked into place by locking elements 754*a-b* in a similar manner as described above with reference to the respective blade, cutting element, and locking element of FIGS. 5A-C.

Figure 8A:
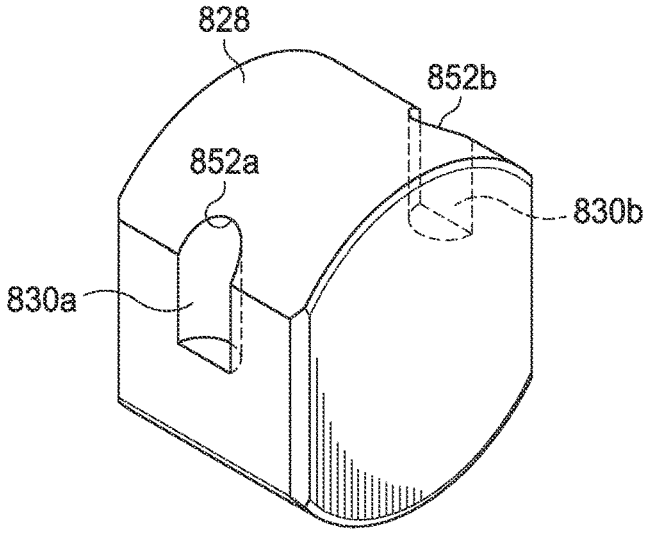
FIG. 8A illustrates an isometric view of an exemplary cutting element.
Figure 8B:
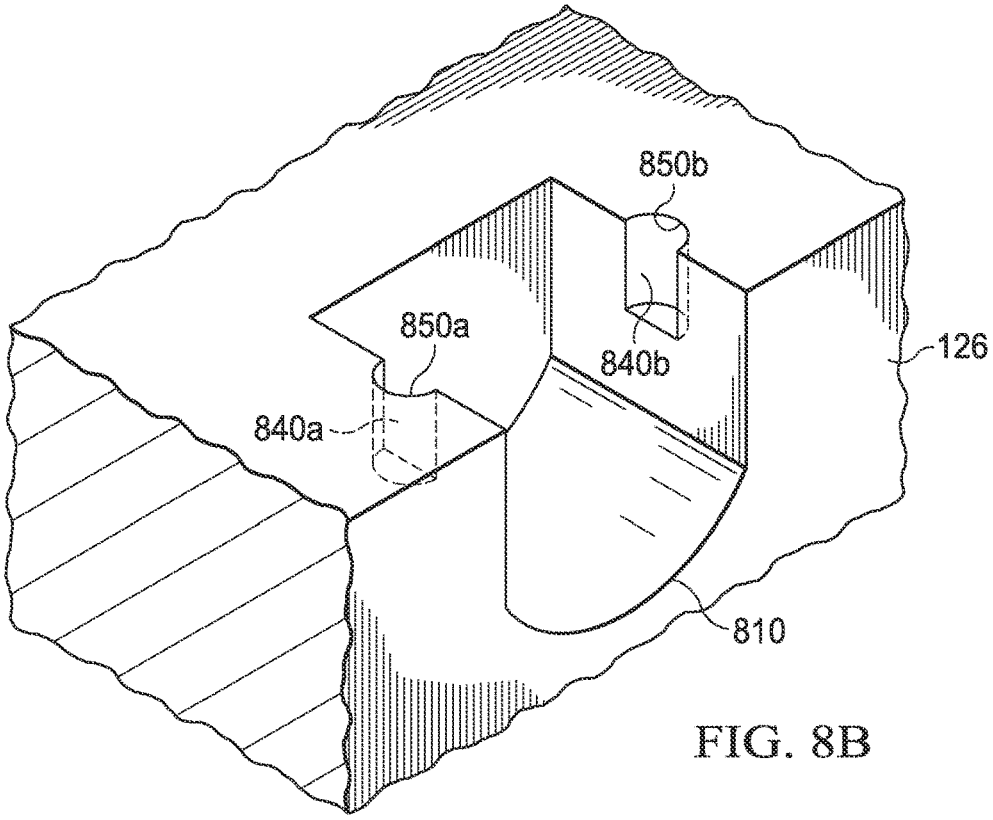
FIG. 8B illustrates an upwardly pointed isometric view of a portion of an exemplary blade that includes a pocket configured to receive the cutting element of FIG. 8A.

FIG. 8A illustrates an isometric view of cutting element 828. FIG. 8B illustrates an upwardly pointed isometric view of a portion of blade 126 that includes pocket 810, which may be configured to receive cutting element 828 (shown in FIG. 8A).

As shown in FIG. 8A, cutting element 828 may include cutting-element groove 830*a*, which may extend inward from cutting-element opening 852*a*. Cutting element 828 may also include cutting-element groove 830*b*, which may extend inward from cutting-element opening 852*b*.

As shown in FIG. 8B, blade 126 may include pocket groove 840*a*, which may adjoin pocket 810, and which may extend inward from pocket opening 850*a*. Blade 126 may also include pocket groove 840*b*, which may adjoin pocket 810, and which may extend inward from pocket opening 850*b*. Cutting element 828 may be placed into pocket 810. Further, one or more grooves of cutting element 828 may align with one or more pocket grooves of blade 126. For example, cutting-element groove 830*a* may align with pocket groove 840*a*, and cutting-element groove 830*b* may align with pocket groove 840*b*. With cutting element 828 placed in pocket 810, cutting element 828 may be secured or locked into place by one or more locking elements.

Although a locking element utilized with cutting element 828 and pocket 810 may include only a single point of access, a locking element may otherwise be utilized in a similar manner as described above with reference to FIGS. 4, 5A-C, and 6A-B to secure or lock into place cutting element 828. When the drill bit, on which cutting element 828 and blade 126 are located, is not in use in drilling operations, the single point of access for the locking element may be utilized to extract the locking element. Accordingly, cutting element 828 may be removed and/or replaced.

Moreover, although the single-ended pocket grooves 840*a-b* are illustrated as aligning with cutting element grooves 830*a-b* at the surface, single-ended pocket grooves may extend from openings fully encompassed within blade 126, and may align with sub-surface grooves of cutting element 828 at a location underneath the respective surfaces of cutting element 828 and blade 126, in a similar manner as described above with reference to FIG. 7. Further, although the pocket and cutting-element grooves illustrated in FIG. 8 are shown as extending inward at an angle perpendicular from the surface of blade 126, the pocket and cutting element grooves may extend inward from any surface of blade 126, and at any angle that may be suitable to counteract the moment force described above with reference to FIG. 4.

Figure 9:
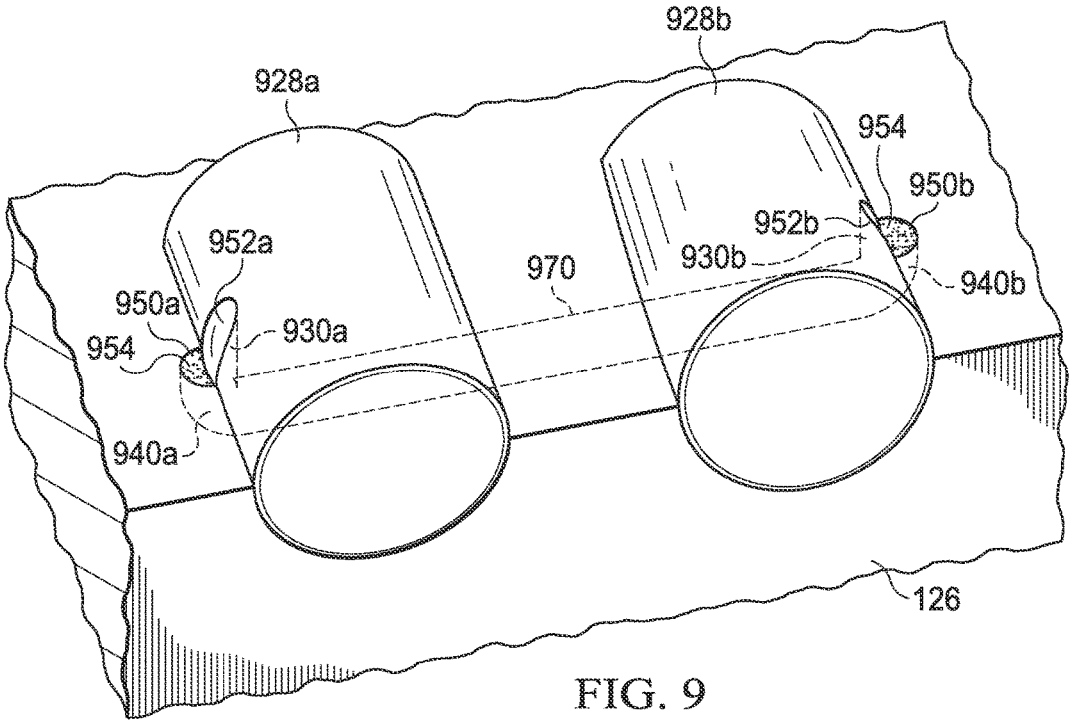
FIG. 9 illustrates an isometric view of an exemplary blade and multiple exemplary cutting elements oriented upwardly.

FIG. 9 illustrates an isometric view of an upwardly oriented blade 126 and multiple cutting elements 928. Cutting elements 928*a-b* and blade 126 are oriented upwardly similar to the upward orientation of cutting elements 128 located on blades 126*a-e* as shown in FIG. 2.

A single locking element may be utilized to secure or lock into place multiple cutting elements on a blade. For example, as shown in FIG. 9, locking element 954 may extend inward from cutting-element opening 952*a* and pocket opening 950*a*, under cutting element 928*a*, under cutting element 928*b*, and up to cutting-element opening 952*b* and pocket opening 950*b*. Cutting-element grooves 930*a* and 930*b* may respectively align with pocket grooves 940*a* and 940*b* to form cavity 970, through which locking element 954 may be placed. For the purposes of the present disclosure, cavity 970 may be considered as either a single cavity formed in separate parts by the different cutting-element and pocket groove combinations, or as multiple cavities formed by the different cutting-element and pocket groove combinations.

With cutting elements 928*a-b* placed in their respective pockets of blade 126, cutting elements 928*a-b* may be secured or locked into place by locking element 928 in a similar manner as described above with reference to the respective blade, cutting element, and locking element of FIGS. 5A-C. Although FIG. 9 illustrates locking element 954 being utilized to secure two cutting elements 928*a-b* in their respective pockets, a single locking element 954 may secure any suitable number of cutting elements (e.g., four, eight, or all of the cutting elements on a blade). In such example configurations, the single locking element may secure the respective cutting elements from the side, from the bottom, or from any suitable portion of the cutting element. Further, a locking element may also be placed through a hole in each of one or more cutting elements, as opposed to a cutting-element groove that aligns with a pocket groove.

FIGS. 10A-E illustrate cross-sectional views of exemplary locking elements 1054 at the intersection of blade 126 and cutting element 1028. As described above with reference to FIGS. 2 and 4 locking elements such as locking element 1054 may secure a cutting element against moment forces that may act to rotate the cutting element out of its pocket during drilling operations. The locking element, and the corresponding grooves in both the cutting element and the blade may have any suitable cross-sectional shape for securing the cutting element against such moment forces.

Figure 10A:
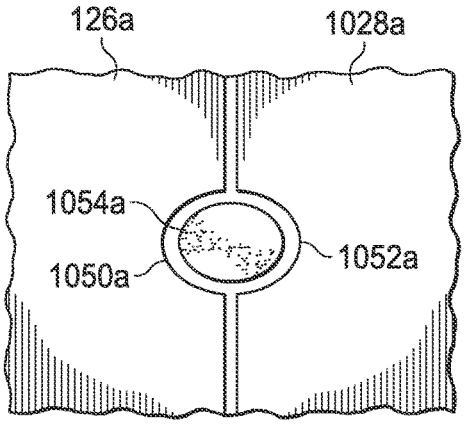
FIGS. 10A-E illustrate cross-sectional views of exemplary locking elements at the intersection of a blade and a cutting element.
Figure 10B:
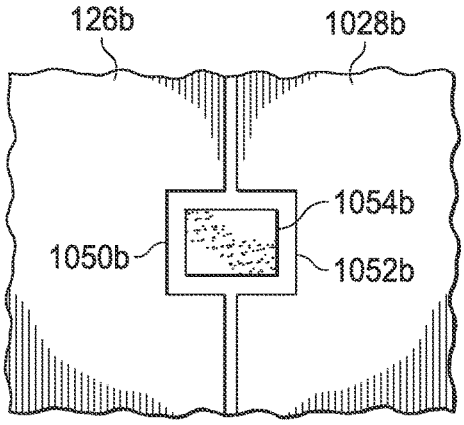
Figure 10C:
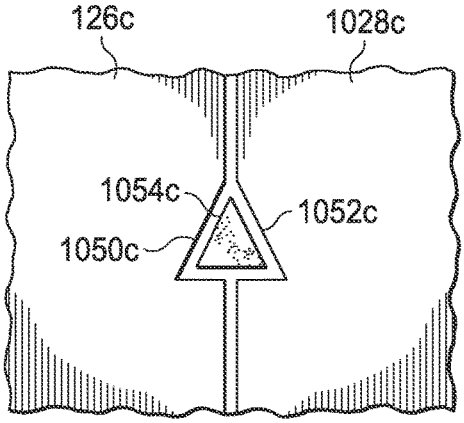

For example, as shown in FIG. 10A, pocket groove 1050*a* and cutting-element groove 1052*a* may combine to form an oval-shaped cavity, through which an oval-shaped locking element 1054*a* may be placed. As another example, as shown in FIG. 10B, pocket groove 1050*b* and cutting-element groove 1052*b* may combine to form a rectangle-shaped cavity, through which a rectangle-shaped locking element 1054*b* may be placed. As yet another example, as shown in FIG. 10C, pocket groove 1050*c* and cutting-element groove 1052*c* may combine to form a triangle-shaped cavity, through which a triangle-shaped locking element 1054*c* may be placed.

Figure 10D:
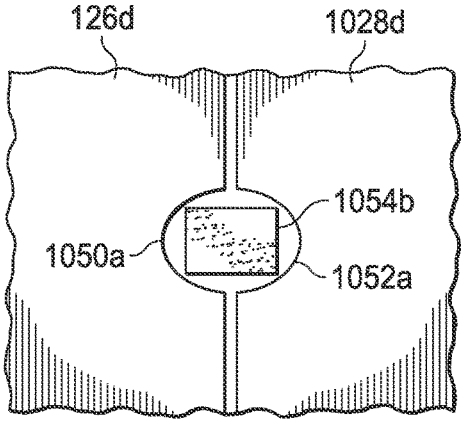
Figure 10E:
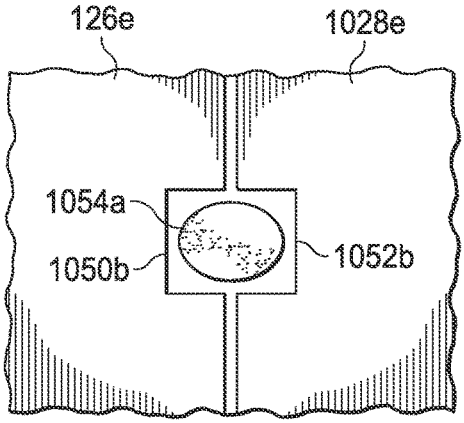

Locking element 1054, and the cavity formed by cutting-element groove 1052 and pocket groove 1054, may also have a circle shape, a square shape, a hexagonal shape, or any other suitable shape for securing cutting element 1028 against moment forces. Locking element 1054 may also have a cross-sectional shape different from the cross-sectional shape of the cavity formed by the cutting-element groove and the pocket groove. For example, as shown in FIG. 10D, pocket groove 1050*a* and cutting-element groove 1052*a* may combine to form an oval-shaped cavity, through which a rectangle-shaped locking element 1054*b* may be placed. As another example, as shown in FIG. 10E, pocket groove 1050*b* and cutting-element groove 1052*b* may combine to form a rectangle-shaped cavity, through which an oval-shaped locking element 1054*a* may be placed.

Figure 11:
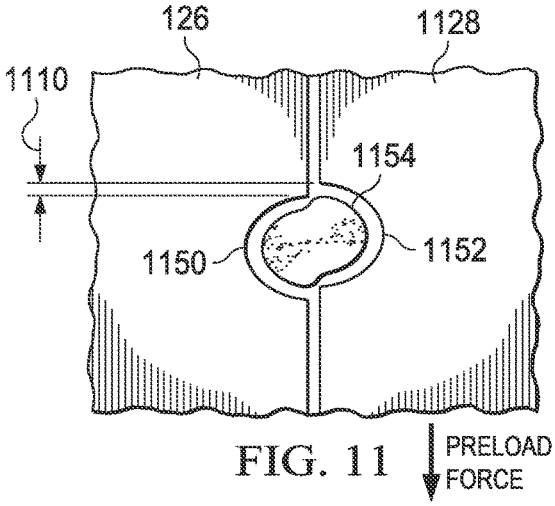
FIG. 11 illustrates a cross-sectional view of an exemplary locking element at an intersection of a blade and a cutting element.

FIG. 11 illustrates a cross-sectional view of an exemplary locking element 1154 at an intersection of blade 126 and cutting element 1128. Although cutting-element grooves are described above, with reference to FIGS. 5A-C, and illustrated in FIGS. 10A-E, as aligning with corresponding pocket grooves, cutting-element grooves and pocket grooves may also be aligned to each other with an offset. For example, cutting-element grooves and the pocket grooves may be offset from each other, but at least partially align such that the combined space inside of the cutting element groove and the pocket groove (when cutting element is placed into the pocket) forms a contiguous cavity. As shown in FIG. 11, cutting-element groove 1152 may be positioned relative to pocket groove 1150 with offset 1110. Such an offset may provide for a pre-load force further securing cutting element 1128 in its pocket. For example, a circular-shaped locking element 1154 including may be inserted into the cavity formed by pocket groove 1150 and the offset cutting-element groove 1152. The material forced into the offset grooves may provide a preload force proportional to the amount of deformation applied to locking element 1154 as locking element 1154 takes the shape of the cavity formed by the offset grooves. As another example, a circular-shaped locking element 1154 including shape memory metal may be inserted into the cavity formed by pocket groove 1150 and the offset cutting-element groove 1152. The circular-shaped locking element 1154 may take the form of the cavity with offset sides, and may generate a pre-load force due to the tendency of the shape memory metal of locking element 1154 to attempt to return to its original circular shape after a triggering event, such as the application of a charge or a temperature.

Figure 12A:
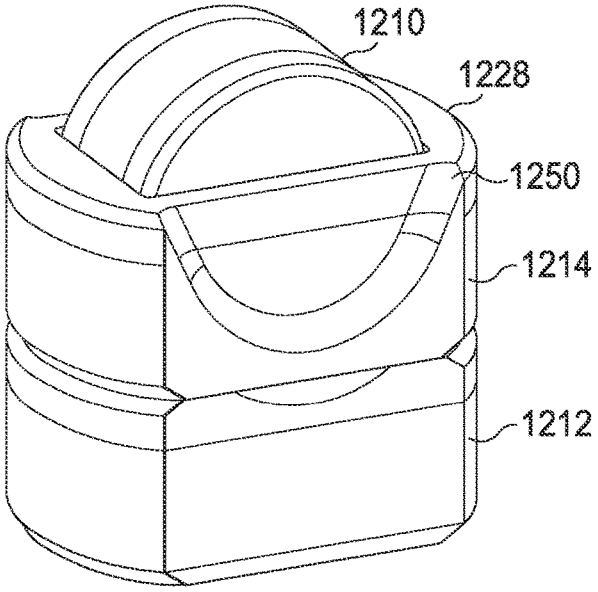
FIG. 12A illustrates an isometric view of an exemplary rolling element.
Figure 12B:
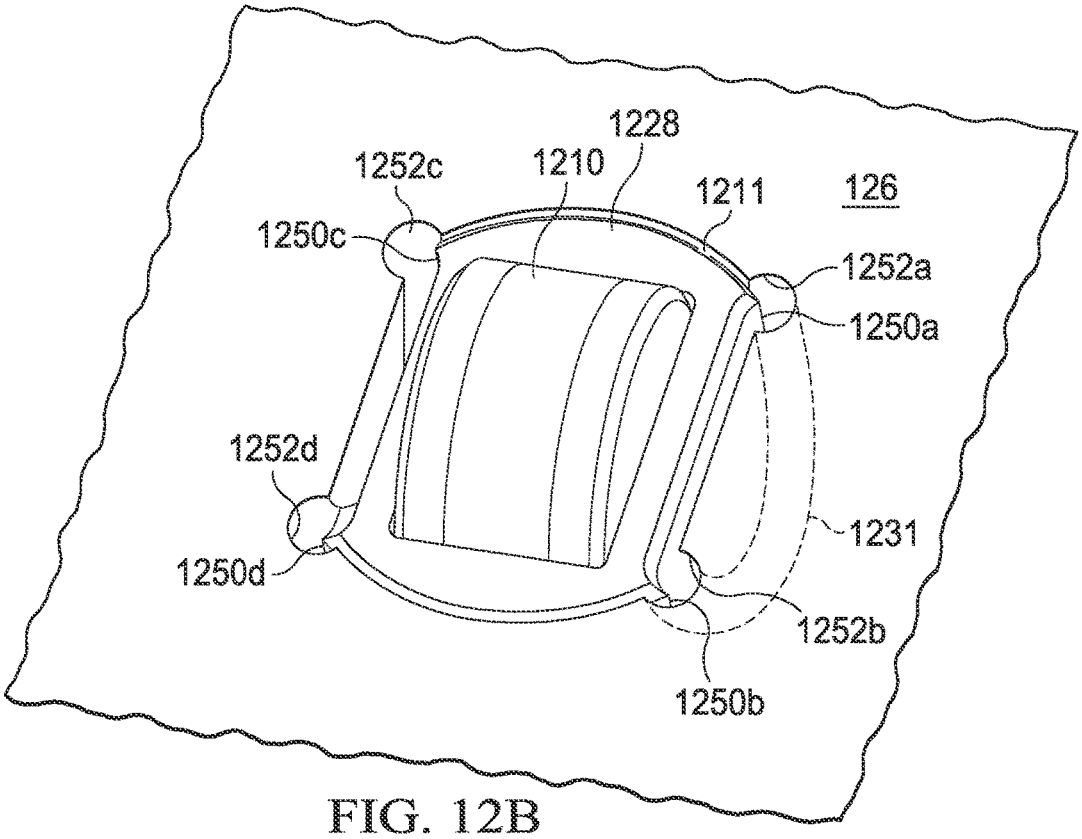
FIG. 12B illustrates an isometric view of an exemplary rolling element placed in a portion of an upwardly pointed blade.

FIG. 12A illustrates an isometric view of rolling element 1228. FIG. 12B illustrates an upwardly pointed isometric view of rolling element 1228 placed in a portion of blade 126. Rolling element 1228 may be utilized, for example, to engage adjacent portions of a downhole formation to form a wellbore during drilling operations. Rolling element 1228 may also be utilized as a depth of cut controller (DOCC). In such implementations, rolling element 1228 may be placed in a portion of blade 126 in a second row of elements behind a primary row of cutting elements on a cutting face of the blade.

Rolling element 1228 may also be utilized with other downhole drilling tools. Depending on the orientation of rolling element 1228 on a downhole drilling tool with respect to the direction of rotation of the downhole drilling tool, rolling element 1228 may perform a non-cutting function, or may perform a cutting function. For example, rolling element 1228 may be placed on a reamer or on a stabilizer such that the direction of rotation of roller 1210, at the outer tip of roller 1210, aligns with the direction of rotation of the reamer or stabilizer in the wellbore during drilling operations. In such implementations, rolling element 1228 may reduce the amount of friction occurring during drilling operations between the downhole drilling tool (e.g., the reamer or stabilizer) and, for example, the sidewall of the wellbore. As another example, rolling element 1228 may be placed on a drill bit such that the direction of rotation of roller 1210, at the tip of roller 1210, is roughly perpendicular to the direction of rotation of the drill bit. In such implementations, rolling element 1228 may interact with and cut into the formation during drilling operations.

Rolling element 1228 may include top element 1214, bottom element 1212, and roller 1210. Top element 1214 may include an inner chamber (not expressly shown) that may house a portion of roller 1210. Moreover, bottom element 1212 may include a rounded inner groove corresponding to the rounded shape of the roller 1210. As shown in FIG. 12A, roller 1210 may protrude from an opening in top element 1214. The opening at the top of top element 1214 may be less than diameter of roller 1210. Thus, top element 1214 may hold roller 1210 in place such that roller 1210 remains contained within the inner chamber or top element 1214. Top element 1214 may also include grooves that may be used in combination with a locking element to secure and/or lock rolling element 1228 into place on a blade of a drill bit.

As shown in FIG. 12B, rolling element 1228 may be placed in pocket 1211 of blade 126. On a first side of rolling element 1228, openings 1250*a* and 1250*b* may align with openings 1252*a* and 1252*b* of blade 126, and the cutting-element groove 1230 (shown in FIG. 12A) may align with a corresponding pocket groove to form a "U" shaped cavity 1231. Likewise, on the other side of rolling element 1228, openings 1250*c* and 1250*d* may align with openings 1252*c* and 1252*d* of blade 126, and second cutting-element groove may align with a second corresponding pocket groove to form a second "U" shaped cavity (not expressly shown) on the other side of rolling element 1228. With rolling element 1228 placed in pocket 1211, cutting element 1228 may be secured or locked into place by one or more locking elements in a similar manner as described above with reference to the respective blade, cutting element, and locking element of FIGS. 5A-C.

Although the present disclosure describes securing drilling elements such as a cutting element, a DOCC, or a rolling element to a drill bit, the locking elements described herein with reference to FIGS. 4-12B may be utilized to secure any suitable drilling element to any suitable downhole drilling tool. For example, the locking elements described herein may be utilized to secure cutting elements, DOCCs, rolling elements, as well as other types of drilling elements that engage the formation during drilling (e.g., a gage pad, a rolling gage pad, an impact arrestor, or an MDR) to a drill bit. Moreover, the locking elements described herein may be utilized to secure suitable drilling elements to drill bits or other types of downhole drilling tools, such as stabilizer or reamers. Further, the example features of the locking elements described above in FIGS. 4-12B may be implemented with each other in any suitable combination. For example, any of the cutting elements described herein may be secured within a pocket of a blade with either one, or two, or more locking elements. The pocket grooves and the cutting-element grooves defining the path of a locking element may be either "U" shaped, "L" shaped, horizontal, vertical, diagonal, or any other suitable shape. Further, for example implementations utilizing multiple sets of pocket and cutting-element grooves with multiple locking elements, each set of pocket and cutting-element grooves may have the same or different shape. As an example, a cutting element may be secured by a first locking element placed in a first set of pocket and cutting-element grooves having a "U" shape, and a second locking element placed in a second set of set of pocket and cutting-element grooves having an "L" shape.

Moreover, each set of pocket and drilling-element grooves may have at least one opening that may be accessible when the drill bit is not in use for drilling operations. Accordingly, the locking element may be removed from the cavity formed by the pocket and drilling-element grooves, and one or more drilling elements secured by the locking element may be removed and/or replaced when the drill bit is not in use for drilling operations.

Embodiments herein may include:

A. A drill bit that includes a bit body and a blade disposed on an exterior portion of the bit body, the blade including a pocket and a pocket groove included in the pocket. The drill bit also includes a drilling element located in the pocket, the drilling element including a drilling-element groove at least partially aligned with the pocket groove, and a locking element extending through a combined space inside the pocket groove and the drilling-element groove.

B. A downhole drilling tool that includes a pocket, a pocket groove included in the pocket, a drilling element located in the pocket, the drilling element including a drilling-element groove at least partially aligned with the pocket groove, and a locking element extending through a combined space inside the pocket groove and the drilling-element groove.

Each of embodiments A and B may have one or more of the following additional elements in any combination:

Element 1: wherein the drilling element comprises a cutting element. Element 2: wherein the drilling element comprises a rolling element. Element 3: wherein the drilling element comprises a depth-of-cut controller (DOCC). Element 4: wherein the locking element comprises a locking ring. Element 5: wherein the locking element comprises a locking wire. Element 6: wherein the locking element comprises one of shaped memory metal, spring steel, and an epoxy. Element 7: wherein the drilling-element groove is aligned with the pocket groove with an offset. Element 8: wherein the cavity formed by the pocket groove and the drilling-element groove includes an end that is accessible from an outer surface of at least one of the blade and the drilling element. Element 9: wherein the cavity forms one of a U-shape and an L-shape from a first end of the cavity to an opposing end of the cavity. Element 10: wherein the cavity formed by the pocket groove and the drilling-element groove has one of a circular cross-sectional shape, a square-type cross-sectional shape, a triangular cross-sectional shape, or a combination thereof. Element 11: the drill bit further includes a locking cap located at an opening of the cavity formed by the pocket groove and the drilling-element groove, the locking cap comprising one of a pressed cap, a threaded plug, a braze, and an epoxy. Element 12: wherein the drilling element has a circular cross section with a flattened side. Element 13: the downhole drilling tool includes a drill bit, and the pocket and the pocket groove are located on a blade of the drill bit. Element 14: the downhole drilling tool includes a reamer, and the pocket and the pocket groove are located on the reamer. Element 15: the downhole drilling tool includes a stabilizer, and the pocket and the pocket groove are located on the stabilizer.

Although the present disclosure has been described with several embodiments, various changes and modifications may be suggested to one skilled in the art. It is intended that the present disclosure encompasses such changes and modifications as fall within the scope of the appended claims.

What is claimed is:

1. A drill bit, comprising:

a bit body;

a blade disposed on an exterior portion of the bit body, the blade including:

a pocket; and a pocket groove adjoining the pocket, the pocket groove extending from a first opening on a surface of the blade to a second opening on the surface of the blade;

a drilling element located in the pocket, the drilling element including a drilling-element groove at least partially aligned with the pocket groove; and a locking element extending through a combined space inside the pocket groove and the drilling-element groove, the first opening providing one point of access to one side of the locking element and the second opening providing another point of access to another side of the locking element.

2. The drill bit of claim 1, wherein the drilling element comprises a cutting element.

3. The drill bit of claim 1, wherein the drilling element comprises a rolling element.

4. The drill bit of claim 1, wherein the drilling element comprises a depth-of-cut controller (DOCC).

5. The drill bit of claim 1, wherein the locking element comprises a locking ring.

6. The drill bit of claim 1, wherein the locking element comprises a locking wire.

7. The drill bit of claim 1, wherein the locking element comprises one of shaped memory metal, spring steel, and an epoxy.

8. The drill bit of claim 1, wherein the drilling-element groove is aligned with the pocket groove with an offset.

9. The drill bit of claim 1, wherein a cavity formed by the pocket groove and the drilling element groove has one of a U-shape and an L-shape from a first end of the cavity to an opposing end of the cavity.

10. The drill bit of claim 1, wherein a cavity formed by the pocket groove and the drilling-element groove has one of a circular cross-sectional shape, a square-type cross-sectional shape, a triangular cross-sectional shape, or a combination thereof.

11. The drill bit of claim 1, further comprising a locking cap located at an opening of a cavity formed by the pocket groove and the drilling-element groove, the locking cap comprising one of a pressed cap, a threaded plug, a braze, and an epoxy.

12. The drill bit of claim 1, wherein the drilling element has a circular cross section with a flattened side.

13. A downhole drilling tool, comprising:

a pocket;

a pocket groove adjoining the pocket;

a drilling element located in the pocket, the drilling element including:

a drilling-element groove at least partially aligned with the pocket groove, the drilling element groove extending from a first opening on a surface of the drilling element to a second opening on the surface of the drilling element; and a locking element extending through a U-shaped combined space inside the pocket groove and the drilling-element groove, the first opening providing one point of access to one side of the locking element and the second opening providing another point of access to another side of the locking element.

14. The downhole drilling tool of claim 13, wherein the drilling element comprises a cutting element.

15. The downhole drilling tool of claim 13, wherein the drilling element comprises a rolling element.

16. The downhole drilling tool of claim 13, wherein the drilling element comprises a depth-of-cut controller (DOCC).

17. The downhole drilling tool of claim 13, wherein:

the downhole drilling tool comprises a drill bit; and the pocket and the pocket groove are located on a blade of the drill bit.

18. The downhole drilling tool of claim 13, wherein:

the downhole drilling tool comprises a reamer; and the pocket and the pocket groove are located on the reamer.

19. The downhole drilling tool of claim 13, wherein:

the downhole drilling tool comprises a stabilizer; and the pocket and the pocket groove are located on the stabilizer.

* * * * *